US006928776B2

(12) United States Patent
Hornung

(10) Patent No.: US 6,928,776 B2
(45) Date of Patent: Aug. 16, 2005

(54) WINDOW SASH FRAME WITH HINGED COMPONENTS

(75) Inventor: Robert Hornung, Southport, CT (US)

(73) Assignee: Sashlite, LLC, Westport, CT (US)

( * ) Notice: Subject to any disclaimer, the term of this patent is extended or adjusted under 35 U.S.C. 154(b) by 4 days.

(21) Appl. No.: 10/739,886

(22) Filed: Dec. 17, 2003

(65) Prior Publication Data

US 2004/0159057 A1 Aug. 19, 2004

Related U.S. Application Data

(63) Continuation of application No. 10/004,112, filed on Nov. 15, 2001, now Pat. No. 6,679,013.

(51) Int. Cl.[7] ..... E04C 2/52

(52) U.S. Cl. ..... 52/204.62; 52/204.1; 52/204.5; 52/204.53; 52/204.591; 52/204.66; 52/202; 52/208; 52/631; 52/730.3; 52/730.4; 52/734.2; 52/204.71; 156/107; 156/109; 49/72; 49/161; 49/162; 49/504; 16/225; 16/365

(58) Field of Search ..... 52/204.62, 204.66, 52/204.53, 730.3, 734.2, 730.4, 631, 204.1, 204.5, 202, 208; 156/107, 109; 49/72, 161, 162, 504

(56) References Cited

U.S. PATENT DOCUMENTS

| | | | | |
|---|---|---|---|---|
| 309,636 A | | 12/1884 | Mann | |
| 2,504,204 A | | 4/1950 | Kiefer | |
| 2,563,378 A | * | 8/1951 | Schnee | 52/172 |
| 2,993,242 A | | 7/1961 | Leisibach | |
| 3,008,196 A | | 11/1961 | Springer et al. | |
| 3,030,673 A | | 4/1962 | London | |
| 3,054,153 A | | 9/1962 | Partsch | |
| 3,775,914 A | | 12/1973 | Patil | |
| 3,791,910 A | | 2/1974 | Bowser | |

(Continued)

FOREIGN PATENT DOCUMENTS

| | | |
|---|---|---|
| CA | 728445 | 2/1966 |
| CH | 209284 | 6/1940 |
| CH | 340607 | 10/1959 |
| CH | 378513 | 7/1964 |
| CH | 433 675 | 9/1967 |

(Continued)

*Primary Examiner*—Carl D. Friedman
*Assistant Examiner*—Christy Green
(74) *Attorney, Agent, or Firm*—Lipsitz & McAllister, LLC

(57) ABSTRACT

Methods and apparatus are provided for mounting one or more glazing panes or insulating glass units into a window sash frame member having spaced side walls joined by an inner facing frame surface with a spacing structure disposed on the frame surface. Glazing panes are placed against strips of adhesive sealant within the window sash frame. Folding glazing beads hingedly attached to the side or inner walls of the frame member are folded against the glazing panes to secure them to the window sash frame member and/or to cover the glazing pane edges.

9 Claims, 9 Drawing Sheets

U.S. PATENT DOCUMENTS

| | | | | | |
|---|---|---|---|---|---|
| 3,872,198 | A | | 3/1975 | Britton | |
| 3,919,023 | A | | 11/1975 | Bowser et al. | |
| 3,990,196 | A | | 11/1976 | Eddins | |
| 4,015,394 | A | | 4/1977 | Kessler | |
| 4,055,031 | A | * | 10/1977 | Okawa et al. | 52/172 |
| 4,109,432 | A | | 8/1978 | Pilz | |
| 4,149,348 | A | | 4/1979 | Pyzewski | |
| 4,207,869 | A | | 6/1980 | Hart | |
| 4,368,226 | A | | 1/1983 | Mucaria | |
| 4,407,105 | A | * | 10/1983 | Frank | 52/204.591 |
| 4,441,290 | A | | 4/1984 | Abell | |
| 4,454,703 | A | | 6/1984 | Sitzler et al. | |
| 4,459,789 | A | | 7/1984 | Ford | |
| 4,464,874 | A | | 8/1984 | Shea, Jr. et al. | |
| 4,479,988 | A | | 10/1984 | Dawson | |
| 4,552,790 | A | | 11/1985 | Francis | |
| 4,564,540 | A | | 1/1986 | Davies et al. | |
| 4,608,796 | A | | 9/1986 | Shea, Jr. | |
| 4,652,472 | A | | 3/1987 | Davies | |
| 4,753,056 | A | | 6/1988 | Pacca | |
| 4,791,762 | A | | 12/1988 | Hwang | |
| 4,831,799 | A | | 5/1989 | Glover et al. | |
| 4,850,175 | A | | 7/1989 | Berdan | |
| 4,873,803 | A | | 10/1989 | Rundo | |
| 4,928,448 | A | | 5/1990 | Phillip | |
| 4,994,309 | A | | 2/1991 | Reichert et al. | |
| 5,061,531 | A | | 10/1991 | Catalano | |
| 5,097,642 | A | | 3/1992 | Richardson et al. | |
| 5,107,655 | A | | 4/1992 | Lindgren | |
| 5,177,916 | A | | 1/1993 | Misera et al. | |
| 5,251,417 | A | | 10/1993 | Yates, Jr. | |
| 5,295,292 | A | | 3/1994 | Leopold | |
| 5,313,761 | A | | 5/1994 | Leopold | |
| 5,364,921 | A | | 11/1994 | Gray et al. | |
| 5,437,902 | A | | 8/1995 | Itoh et al. | |
| 5,494,715 | A | | 2/1996 | Glover | |
| 5,544,454 | A | | 8/1996 | Richardson et al. | |
| 5,568,714 | A | | 10/1996 | Peterson | |
| 5,640,828 | A | | 6/1997 | Reeves et al. | |
| 5,653,073 | A | | 8/1997 | Palmer | |
| 5,665,823 | A | | 9/1997 | Saxena et al. | |
| 5,713,159 | A | | 2/1998 | Schmidt | |
| 5,940,937 | A | | 8/1999 | Churchill et al. | |
| 5,950,398 | A | | 9/1999 | Hubbard | |
| 6,055,783 | A | | 5/2000 | Guhl et al. | |
| 6,206,453 | B1 | * | 3/2001 | Farrar et al. | 296/146.15 |
| 6,209,269 | B1 | | 4/2001 | Valderrama | |
| 6,286,288 | B1 | | 9/2001 | France | |
| 6,314,691 | B1 | | 11/2001 | Takagi et al. | |
| 6,401,428 | B1 | | 6/2002 | Glover et al. | |
| 6,467,226 | B2 | | 10/2002 | Dodson et al. | |
| 6,477,812 | B2 | | 11/2002 | Boone et al. | |
| 6,536,182 | B2 | * | 3/2003 | France | 52/786.1 |

FOREIGN PATENT DOCUMENTS

| | | |
|---|---|---|
| DE | L 17545 | 12/1956 |
| DE | 1123457 | 2/1962 |
| DE | 1915245 | 10/1970 |
| DE | 2041038 | 2/1971 |
| DE | 25 27 013 | 1/1976 |
| DE | 24 49 726 | 4/1976 |
| DE | 24 57 472 | 6/1976 |
| DE | 26 07 287 | 8/1977 |
| DE | 26 14 049 | 10/1977 |
| DE | 27 23 283 | 4/1979 |
| DE | 89 01 593 | 3/1989 |
| DE | 38 25 580 | 2/1990 |
| EP | 0 065 510 | 11/1982 |
| EP | 0 328 823 | 8/1989 |
| EP | 0 381 646 | 8/1990 |
| FR | 1079389 | 11/1954 |
| FR | 60912 | 2/1955 |
| FR | 1429980 | 1/1966 |
| FR | 1 459 169 | 4/1966 |
| FR | 2420014 | 11/1979 |
| FR | 2501773 | 9/1982 |
| FR | 2518158 | 6/1983 |
| FR | 2612244 | 9/1988 |
| FR | 2624545 | 6/1989 |
| FR | 2648178 | 12/1990 |
| FR | 2 653 470 | 4/1991 |
| FR | 2 672 930 | 8/1992 |
| FR | 2708030 | 1/1995 |
| GB | 234987 | 6/1925 |
| GB | 949997 | 2/1964 |
| GB | 1 535 173 | 12/1978 |
| GB | 2 077 834 | 12/1981 |
| GB | 2 254 358 | 10/1992 |
| HU | 185 075 | 10/1983 |
| HU | 219 640 | 3/1996 |
| IT | 628775 | 11/1961 |
| SU | 726293 | 4/1980 |
| WO | 91/08366 | 6/1991 |
| WO | 98/02632 | 1/1998 |
| WO | 98/25001 | 6/1998 |

* cited by examiner

WINDOW SASH FRAME WITH HINGED COMPONENTS

This application is a continuation of U.S. patent application Ser. No. 10/004,112 filed on Nov. 15, 2001 U.S. Pat. No. 6,679,013.

BACKGROUND OF THE INVENTION

The present invention relates generally to commercial, residential and architectural windows and, more particularly, to a window, door or skylight sash assembly with hinged glazing components, such as integral glazing beads, and methods for manufacturing the same.

DESCRIPTION OF THE RELATED ART

As is currently well known in the art, insulating glass units, or IG units, are widely used as elements of windows, skylights, doors and related products, including vehicles. Such units are used to reduce heat loss from building interiors in winter, and reduce heat gain into air-conditioned buildings in summer. The insulating glass units are typically formed separately from the sash, and then in a separate step the insulating glass unit is installed in a sash.

Alternative methods for manufacturing insulating glass structures, where the IG unit is formed integrally with the sash itself, are disclosed in J. France U.S. patent application Ser. No. 09/307,825 ('825) filed on May 7, 1999, entitled "Integrated Multipane Window Unit and Sash Assembly and Method for Manufacturing the Same", now U.S. Pat. No. 6,286,288, corresponding to PCT published application WO 00/68539 dated Nov. 16, 2000; J. France U.S. patent application Ser. No. 09/907,528 filed on Jul. 17, 2001, entitled "Integrated Multipane Window Unit and Sash Assembly and Method for Manufacturing the Same"; and R. Hornung et al. U.S. patent application Ser. No. 09/882,295 ('295) filed on Jun. 15, 2001, entitled "Insulating Glass Sash Assemblies with Adhesive Mounting and Spacing Structures"; all incorporated herein by reference. In addition to providing a comprehensive explanation of the prior art, the aforementioned '825 patent application discloses an improved but less complex insulating glass structure that is integrated with the window sash.

More particularly, the aforementioned '825 patent application discloses a multipane window unit in which a sash frame is formed having an integral spacing structure upon which glazing panes are directly affixed. The integral spacing structure provides vertical internal glazing surfaces extending from the sash. Adhesive can be affixed to the vertical internal glazing surfaces to attach the glazing panes. In this manner, a rigid, structural sash frame is formed prior to attachment of the glazing panes, thereby eliminating the need for using separately manufactured insulating glass units, while obtaining similar and improved thermal benefits.

Further improvements to insulating glass structures for use in windows, doors and the like, while incorporating the basic concept of the aforementioned '825 patent application, i.e., the provision of a sash and IG unit in an integrated structure, can be found in the aforementioned '295 patent application. In addition to providing a comprehensive explanation of the prior art, the '295 patent application discloses an improved but less complex insulating glass structure that is integrated with the window sash. In particular, the '295 application discloses, inter alia, an integrated insulating glass and sash structure where parallel glass panes are directly mounted to and supported on the sash by an adhesive mounting or an adhesive mounting and spacing structure.

Advantageously, such an adhesive can be applied to the sash directly in the form of a bead, such as a bead of sealant which can also function as the spacer element between the glass panes. Alternatively, the adhesive can be co-extruded (or post-extruded) with the sash profile. Still further, the adhesive can comprise an integrated, single component desiccated sealant-adhesive glazing material. In a particularly advantageous embodiment, this material can be preformed into a variety of shapes and sizes, thereby providing, when adhered to the sash profile, an integrated sash/glazing mechanism. Methods for assembling multipane window units using the disclosed adhesive spacing and mounting structure are also disclosed.

Another reference indicative of the current state of the art for window technology is represented by U.S. Pat. No. 5,713,159 ('159), issued in the name of Schmidt, in which lineal plastic material comprises multiple components extruded as a single piece and secured to one another by at least one wall formed in the lineal material. As shown in FIG. 2 of the Schmidt patent, one component 3 is provided with a recess 17 and another of the components 9 has a leg which, upon separation of the components at the wall, fits into the recess 17 of the one component 3 to provide a mated component system. The Schmidt patent refers to a generic panel securing system with a removable and/or separable construction of components for holding the glazing pane 11. A unit and process is described and illustrated in which the components must be separated prior to securing the panel. This process is cumbersome and requires additional labor, trimming of excess or edge torn material, and does not guarantee a rapid (streamlined) fitting of the holding (securing) component to the main component.

Consequently, a need has arisen for an improved but less complex mechanism that provides a window sash incorporating a thermally sealed and structurally sealed air pocket bounded on two sides by a glazing pane, for use in otherwise conventional functioning windows.

It is noted that although the invention is described using glass panes, panes of other materials can be substituted. Such panes can comprise, for example, clear or frosted plastic, such as Plexiglas, tempered glass, safety glass, security glass, privacy glass, or any other known glazing material.

SUMMARY OF THE INVENTION

According to the invention, a window sash frame member is provided for constructing a window sash. A length of sash frame member has first and second spaced side walls joined by an inner facing frame surface extending substantially over the length of the sash frame member. A first glazing bead extends substantially over the length of the sash frame member and is hingedly attached to at least one of (i) the first side wall of the sash member, or (ii) said inner facing frame surface.

The first glazing bead can comprise, for example, a first side leg having first and second opposite ends, with the first end of the side leg hingedly and integrally connected to the sash frame member. The second end of the side leg is adapted to cover a peripheral portion of a glazing pane situated adjacent to the inner facing frame surface when the glazing bead is pivoted about the hinged connection toward the glazing pane. In one embodiment, the glazing bead includes an integral setting block extending in a transverse direction to the first side leg. The integral setting block can, for example, extend in a substantially perpendicular direction to the first side leg.

A first locking member can be disposed on the first side leg, with a second locking member disposed on the sash frame member. The first and second locking members cooperate to lock the glazing bead to the sash frame member with the second end covering the peripheral portion. In an example embodiment, the first locking member comprises a locking lug projecting from the first side leg between the first and second ends of the side leg, and the second locking member comprises a locking notch adapted to securely receive and grip the locking lug. Alternatively, the second locking member can comprise a locking lug projecting from the sash frame member, with the first locking member comprising a locking notch between the first and second ends. It should be appreciated that other locking member embodiments including snap, lug, ratchet or adhesive arrangements can also be provided in accordance with the invention.

A second glazing bead can also be provided. For example, the second glazing bead can extend substantially over the length of the sash frame member and be hingedly attached to at least one of (i) the second side wall of the sash member, or (ii) the inner facing frame surface. The first and second glazing beads can each comprise a side leg having first and second opposite ends, the respective side legs being hingedly and integrally connected at the first end thereof to the sash frame member. The second end of each side leg can be adapted to cover a peripheral portion of a glazing pane situated adjacent to the inner facing frame surface when the respective glazing bead is pivoted about its hinged connection toward the glazing pane. Each of the glazing beads can include a first locking member disposed on the respective glazing bead side leg. The first locking member of each glazing bead can be adapted to cooperate with a respective second locking member disposed on the sash frame member to lock the glazing bead to the sash frame member with the second end of the glazing bead covering the peripheral portion of one or more glazing panes. In an insulating glass embodiment, where two glazing panes are separated by an insulating (e.g., air or gas filled) space, the second end of the first glazing bead can be designed to cover the peripheral portion of a first glazing pane, and the second end of the second glazing bead can be designed to cover the peripheral portion of a second glazing pane that is parallel to the first pane.

In an illustrated embodiment, the first glazing bead is integrally attached along the intersection of the inner facing frame surface and the first side wall of the sash member. Similarly, the second glazing bead can be integrally attached along the intersection of the inner facing frame surface and the second side wall of the sash member. Other locations for the hinged glazing beads are also possible, and will be apparent to those skilled in the art in view of the teachings of the present invention.

A first strip of adhesive can be provided between the second end of the first glazing bead and the first glazing pane. A second strip of adhesive can be provided between the second end of the second glazing bead and the second glazing pane. A third strip of adhesive can be located adjacent the inner facing frame surface and adapted to extend between the first and second glazing panes. The adhesive can comprise, for example, any of a variety of different adhesive types and structures, such as a bead of adhesive (sometimes referred to as "sealant"), a preformed adhesive foam, a preformed adhesive tape, and/or a chemical sealant. The term adhesive as used herein is meant to be broad enough to encompass a sealant, unless otherwise stated.

The hinged glazing beads of the present invention can be provided in various shapes and sizes. For example, they can be square or rectangular, in which case the side wall thereof will be substantially parallel to the respective side wall of the sash member when in a final position adjacent the respective glazing pane. Alternatively, they can be beveled from the respective side wall of the sash member toward the respective glazing pane when in a final position adjacent the glazing pane. In another embodiment, they are curved from the respective side wall of the sash member toward the respective glazing pane when in a final position adjacent the glazing pane. Any other suitable shape can also be used for the glazing beads.

A method is disclosed for mounting a glazing pane into window sash frame member. A length of sash frame member is provided, which has first and second spaced side walls joined by an inner facing frame surface extending the length of the sash frame member. A glazing pane mounting structure of the sash frame member has at least a first side glazing surface adjacent the inner facing frame surface. In accordance with the method, a first glazing pane is placed against the first side glazing surface. A first glazing bead hingedly attached to the first side wall is folded about the hinge to cover a peripheral portion of the first glazing pane. The first glazing bead can be secured in position adjacent the first glazing pane, e.g., via a locking structure.

The mounting structure can also be provided with a second side glazing surface adjacent the inner facing frame surface. A second glazing pane is placed against the second side glazing surface. A second glazing bead hingedly attached to the second side wall is folded about the hinge to cover a peripheral portion of the second glazing pane. The second glazing bead is then secured in position adjacent said second glazing pane. The glazing beads can be any desired thickness, including paper thin.

A method is also disclosed for mounting first and second glazing panes to a window sash frame member. In accordance with this method, a length of sash frame member having first and second spaced side walls is provided. The side walls are joined by an inner facing frame surface extending the length of the sash frame member. A glazing surface is provided adjacent the first side wall of the sash frame member. A first strip of adhesive sealant is placed on the glazing surface, either directly or via a first glazing pane that is placed against the glazing surface with the first strip of adhesive sealant therebetween. A second strip of adhesive sealant is placed on the first glazing pane and/or on the inner facing frame surface. A second glazing pane is placed against the second strip of adhesive sealant. A third strip of adhesive sealant is placed on a glazing bead hingedly attached to the second side wall and/or on the second glazing pane. The glazing bead is folded to secure it to the second glazing pane via the third strip of adhesive sealant.

Advantages of the present method can be readily seen from the present disclosure; however, they can be summarized in the providing of such a window unit in a manner that is less capital intensive and requires fewer manufacturing steps, equipment and personnel than what is required to manufacture windows using existing IG units.

Also disclosed is a window or door component that comprises a frame for providing a receiving surface for a glazing pane or screen. At least one hinged element is hingedly attached along a length of at least one side of the frame. The hinged element is adapted to pivot about a hinge line to engage and hold a glazing pane or screen, placed on the receiving surface, in place in the frame.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
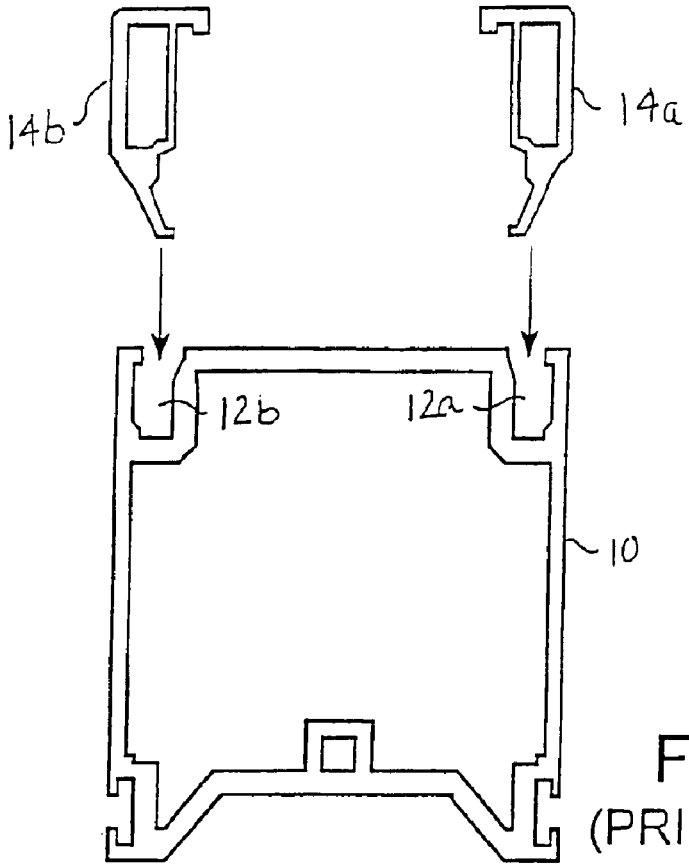
FIG. 1 (PRIOR ART)
FIG. 1 is a is a cross-sectional view of a prior art construction showing a window sash profile portion having a channel for retaining a glazing bead or clip as well known in the art.
Figure 2:
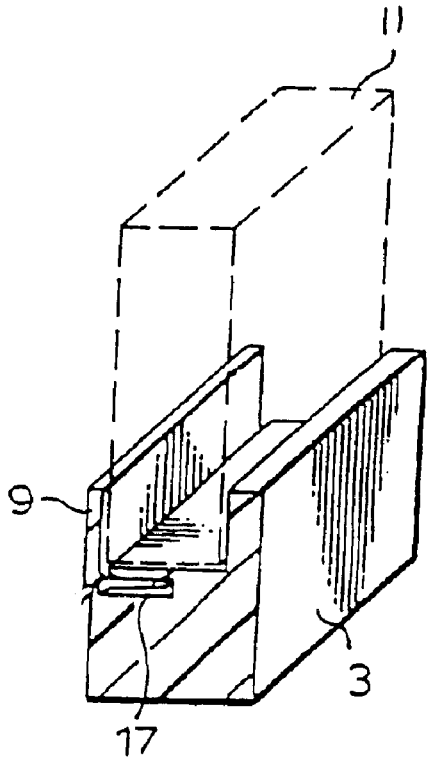
FIG. 2 (PRIOR ART)
FIG. 2 is a perspective view of a prior art construction where separate framing and retaining components are attached to each other to secure a panel therebetween.

Referring now to FIG. 1, a prior art sash profile 10, which may be fabricated from vinyl, e.g., polyvinyl chloride (PVC) or any other material used for window frames, such as aluminum, wood, other plastics and the like, is provided for use in manufacturing an insulating glass window. The sash profile 10 can fabricated in any known manner, for example, by extrusion. Although only a cross-section of the profile 10 is illustrated, it should be appreciated that the profile material will be provided in various lengths necessary to assemble a complete sash frame, which may be square, rectangular, oval, circular, or any other custom window shape as well known in the art. The illustrated sash profile 10 includes channels 12*a*, 12*b* for receiving glazing beads or clips 14*a*, 14*b*, respectively, to secure glazing panes (not shown) to the sash, as is well known in the art. It can be understood that the need to install separate glazing beads or clips for each window is inefficient because the process is cumbersome and requires additional labor, trimming of excess or edge torn material, and does not guarantee a rapid (streamlined) fitting of the holding (securing) component to the main sash component. Moreover, color matching of the glazing bead to the sash is often a problem due to the use of different materials and/or separately manufactured components for each. By providing a hinged glazing bead integrally with the sash frame, color matching is no longer a problem.

Figure 3:
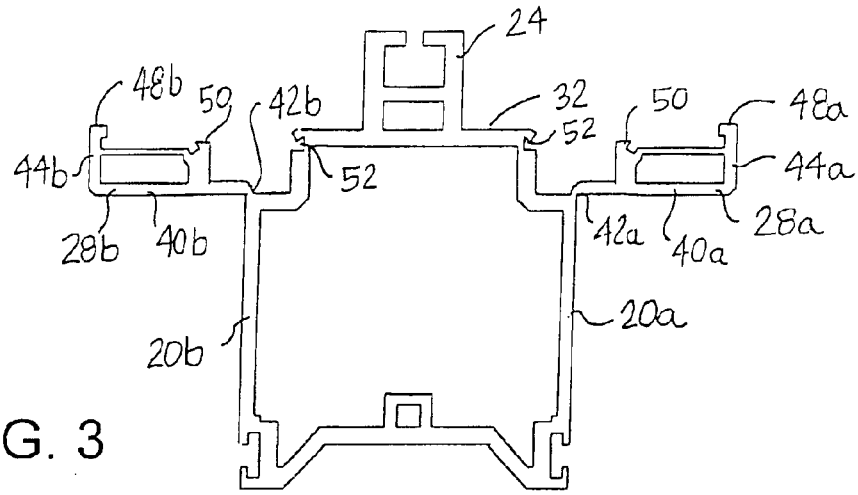
FIG. 3 is a cross-sectional view of a sash profile having hinged components (e.g., glazing beads) in accordance with the invention.
Figure 4:
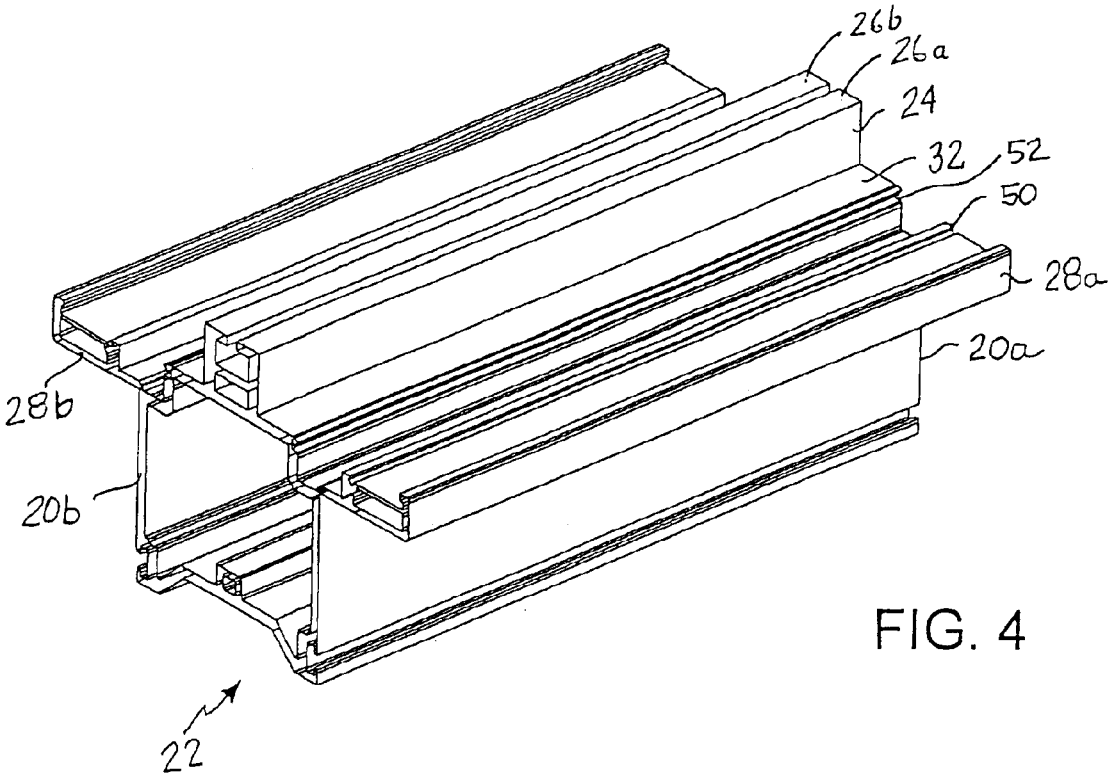
FIG. 4 is a perspective view showing a window sash profile portion having a hinged glazing bead/stop on either side of the profile portion in accordance with the invention.

In accordance with the present invention, as shown in FIGS. 3 and 4, a sash profile 20, which may be fabricated as a strip of sash frame 22 from vinyl, e.g., polyvinyl chloride (PVC) or any other material used for window frames, such as aluminum, wood, other plastics and the like, is provided for use in manufacturing an insulating glass window. The sash frame 22 can fabricated in any known manner, for example, by extrusion or injection molding. Although only a short section of the frame 22 is illustrated in FIG. 4, it should be appreciated that the frame material will be provided in various lengths necessary to assemble a complete sash frame, which may be square, rectangular, oval, circular, or any other custom window shape as well known in the art.

Figure 6:
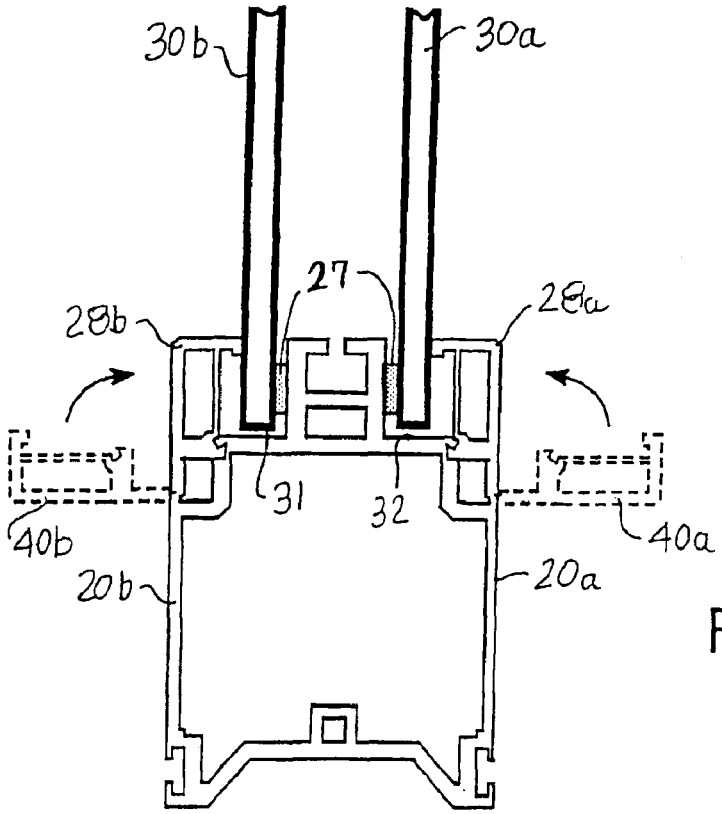
FIG. 6 is a cross-sectional view of the embodiment of FIG. 4 showing the folding movement of the glazing bead/stop into the secured position against a pair of glazing panes in accordance with the invention.

The illustrated sash profile 20 incorporates a spacing structure 24 formed integrally with the sash frame 22 and protruding inward toward the viewing opening of the window. The integral spacing structure 24 of the illustrated embodiment (which is only an example) incorporates two vertical, side glazing surfaces (first and second glazing pane mounting surfaces) 26*a*, 26*b* upon which a beads of adhesive or sealant 27, as shown in FIG. 6, can be affixed. Since the expansion coefficient of the glazing panes 30*a*, 30*b* is typically less than that of a PVC extrusion, such a sealant configuration prevents the glazing panes from making direct contact with the extrusion vinyl. This structure avoids the disadvantages inherent in the state of the art, yet forms both a thermally sealed and structurally sealed space bounded on two sides by a glazing pane (e.g., a glass or plastic panel), and sealed around its periphery by an internal glazing structure. Further, it is anticipated that the dimensions of the glazing panes 30 would be overall less than that of the inner sash frame surface (inner facing frame surface) 32, thereby allowing for the glass to expand and contract without stresses that result in failure on either the glass or the sealant. Further still, any glass (or other glazing pane material) preferably rests above this extrusion surface, thereby eliminating any stress against the edge of the glass that could cause cracking, as well as providing for water drainage away from the sealant, thereby lessening the opportunity for the sealant to come into contact with water.

A significant feature of the present invention relates to the glazing beads or clips (first and second hinged components) 28*a*, 28*b*, as shown in FIGS. 3–6, which are adapted for securing respective glazing panes 30*a*, 30*b* and/or covering the periphery (e.g., edges) of the glazing panes. The glazing beads or clips 28*a*, 28*b* extend the length of the sash frame 22 and are separate from each other. The glazing beads or clips 28*a*, 28*b* allow each pane 30*a*, 30*b*, as shown in FIG. 6, to be mounted and to function independently of each other.

The glazing beads or clips 28*a*, 28*b* each have a side leg 40*a*, 40*b* which forms an extension of the sides 20*a*, 20*b*, respectively, of the sash frame member 22 when the glazing beads are locked into place as shown in FIG. 6. As noted above, the glazing beads can be of any desired thickness, depending on their function, which may be aesthetic and/or functional. One end 42*a*, 42*b* of each of the side legs 40*a*, 40*b* is hingedly and integrally connected to the sash frame 22 at the respective frame side walls 20*a*, 20*b*. For example, where the sash frame is constructed from vinyl, a living hinge can be provided at the intersection of each of the glazing beads 28*a*, 28*b* with the respective sash frame side wall 20*a*, 20*b*. The living hinge can be formed, for example, by providing a groove at the intersection about which the glazing bead can pivot. Depending on the overall structure, it may be advantageous to extrude the glazing bead at an angle with respect to the sash profile in order to avoid interference with a corner welding plate when the sash profile is mitered to form the sash frame.

It is noted that the hinge does not have to be continuous along the sash profile. In particular, intermittent openings can be provided to allow for weeping of rain water and/or condensation, etc. from behind the glazing bead. Moreover, a taped, glued or welded hinge can be provided instead of the living hinge illustrated. Alternatively, the hinged connection can be formed by a separate hinge component which joins the glazing bead and the sash profile. Such a separate component can comprise, e.g., a thin welded (e.g., ultrasonically), chemically bonded, or glued strip of material, such as matching plastic, that is attached to the glazing bead and sash profile.

Figure 7:
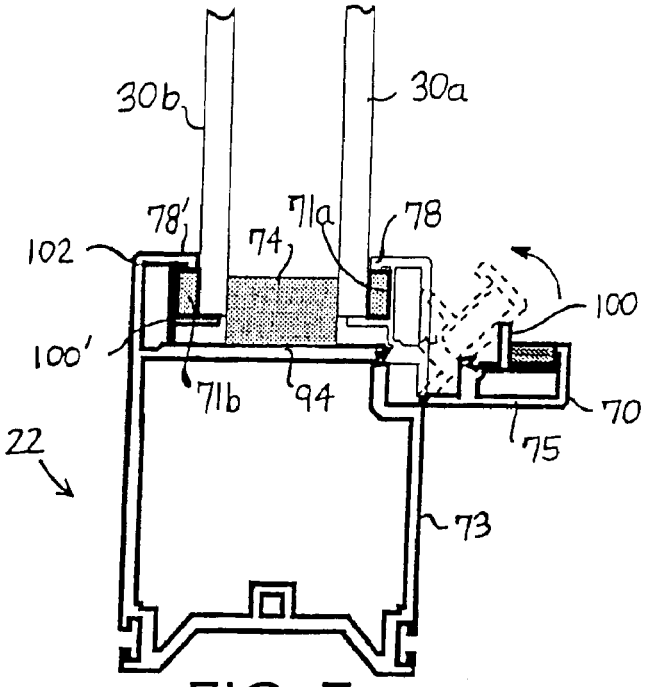
FIG. 7 is a cross-sectional view of another embodiment similar to that shown in FIG. 6, but wherein the window sash profile portion has a folding glazing bead/stop on only one side of the profile portion in accordance with the invention.

The opposite end 44*a*, 44*b* of the side legs 40*a*, 40*b*, respectively, forms a pane support which extends transverse and preferably approximately perpendicular to the side legs 40*a*, 40*b*. The end 48*a*, 48*b* of pane support 44*a*, 44*b*, respectively, forms a surface, preferably flat, which can engage the panes 30*a*, 30*b*, respectively, and secure them in place. As can be seen in FIG. 6, the glazing beads 28*a* 28*b*, when folded into place against the glazing panes 30*a*, 30*b* respectively, cover the outer periphery (including edges 31) of the glazing panes. The effect is to hide the glazing pane edges, providing a more aesthetic appearance for the completed sash. As illustrated in FIG. 7, discussed in greater detail below, a strip of adhesive 71*a*, 71*b* can be optionally provided between the glazing beads and the glazing panes. This adhesive can secure the glazing beads to the glazing panes and/or provide a sealant function.

In a preferred embodiment, locking elements are provided to secure the glazing beads to the sash frame. For example, a locking lug 50 can be provided on each glazing bead to engage with a corresponding notch 52 on the sash frame 22. It is within the scope of the invention to use any type of locking elements to secure the glazing bead to the sash frame when the former is folded along its hinge toward the glazing pane to cover the periphery of the pane. Such locking means can be provided at various locations on the hinged component (e.g., glazing bead) and sash profile (including the side and/or top of these elements), as will be apparent to those skilled in the art. Such locking mechanisms can comprise, for example, locking channels and mating ribs, hook and loop fasteners, snaps, ratchets and the like. To further increase the secure connection of the glazing beads, or instead of the locking elements, an adhesive can be used between the glazing beads and the outer surface of the respective glazing pane. Alternatively, an adhesive can be placed between the glazing beads and respective portions of the sash frame.

Figure 5:
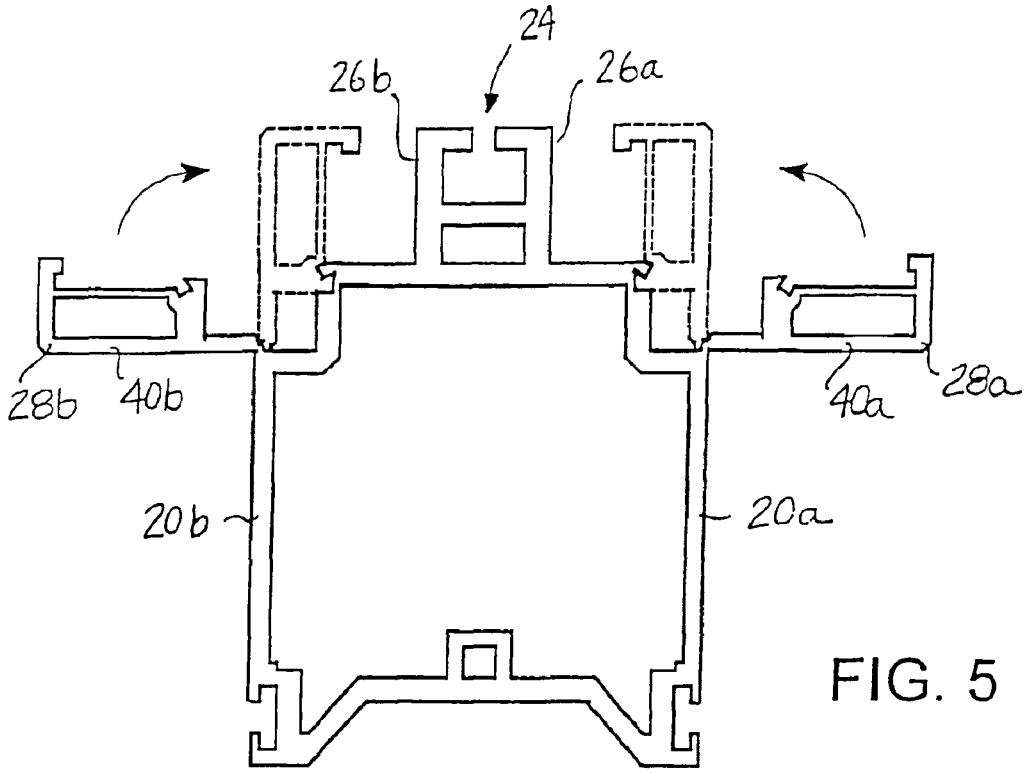
FIG. 5 is a cross-sectional view of the embodiment of FIG. 4 showing the folding movement of the glazing bead/stop into the secured position in accordance with the invention.

In one contemplated assembly sequence, an assembler or automated machinery (e.g., a robotic assembler) can begin by placing beads of adhesive sealant 27 upon the vertical internal glazing surfaces 26*a*, 26*b*. Then the panes 30*a*, 30*b* are placed against the beads of sealant 27 so that the bottom ends of the panes are preferably spaced from the inner sash frame surface 32. Next, the assembler rotates or folds the glazing beads 28*a*, 28*b* so that the side legs 40*a*, 40*b* pivot about the point of intersection with the sash frame 22, as shown in FIG. 5, until the side legs are disposed in the vertical position, as shown in FIG. 6. Then, the glazing beads 28*a*, 28*b* are securely held in place by the combination of the locking lugs and notches 50, 52.

The resulting integrated multipane window unit and sash combination has a sash frame that incorporates a spacing structure formed integrally with the sash frame, the spacing structure including at least two vertical internal glazing surfaces upon which adhesive, or sealant 27 is affixed. The sealant strips or beads 27, connecting respective glazing panes 30*a*, 30*b* to the integral spacing structure 24, are isolated from each other, and thereby allow each pane 30 to function independently.

It should be appreciated that other spacing and mounting structures can be provided instead of the legs 26*a*, 26*b* illustrated. For example, the spacing and mounting structure can be formed entirely of one or more beads of similar or dissimilar adhesive, or adhesive foam, tape or other adhesive strips.

When the panes 30*a*, 30*b* need to be removed or adjusted, or replaced, the glazing beads 28*a*, 28*b* can be unlocked by forcefully pulling them away from the panes 30*a*, 30*b* so that locking lugs 50 disengage from the frame locking notches 52, respectively. Then, the glazing beads 28*a*, 28*b* fold back to their pre-engaged location, as shown in FIGS. 5 and 6.

While the embodiment, as shown in FIGS. 3 through 6 include two hinged glazing beads, it is within the terms of the present invention to use a single hinged glazing bead or clip for one glazing plane and a fixed glazing bead or clip for the other glazing plane. Moreover, while the preferred embodiment is directed to installing a pair of spaced glazing panes into a window sash frame member for constructing a window sash, it is also within the terms of the present invention to install more than two, or only a single glazing pane into a window sash frame member for constructing insulating or non-insulating glazing pane window sashes.

Referring to FIG. 7, there is illustrated an alternative embodiment where a single glazing bead 70 substantially extends along the entire length of the sash frame member 22. As with the embodiments described above, the hinged connection between the single glazing bead 70 and the length of sash frame member 22 can be intermittent to allow water to weep out from behind the bead.

In the alternative embodiment of FIG. 7, a pair of adhesive strips, tape or beads 71*a*, 71*b* are provided, together with an intermediate, adhesive spacing strip or bead 74. The strips or beads 71*a*, 71*b* of sealant, in conjunction with the intermediate sealant strip or bead 74, are adapted for securing respective glazing panes 30*a*, 30*b* in the vertical disposition. The strips or beads 71*a*, 71*b* of adhesive, and the intermediate, spacing adhesive strip or bead 74, extend the length of the sash frame 22 and allow each pane 30*a*, 30*b*, as shown in FIG. 7, to be mounted and to function independently of each other. Although a specific spacing and mounting structure is illustrated in FIG. 7, it should be appreciated that any of the other spacing and mounting structures can be substituted in accordance with the inventive concepts. For example, the single hinged glazing bead concept of FIG. 7 can also be used with the spacing and mounting structure shown in FIGS. 3–6, and vice-versa.

The glazing bead 70 shown in FIG. 7 has a side leg 75 that forms an extension of the side 73 of the sash frame 22 when the glazing bead 70 is locked into place. The glazing bead is hingedly and integrally connected to the sash frame 22 at its intersection with the frame side 73. Other structural features of the glazing bead are essentially the same as the glazing beads discussed above in connection with FIGS. 3–6. Additionally, as shown in FIG. 7, a glazing bead in accordance with the invention can be provided with a pane base support 100 on which the pane 30*a* rests when the glazing bead 70 is in place against the pane. As shown, the strip or bead of adhesive 71*a* is disposed within the glazing bead between the pane base support 100 and a pane support 78 of the glazing bead.

The sash frame 22 of the embodiment shown in FIG. 7 also has a fixed glazing bead 102 which preferably extends the length of the frame. The fixed glazing bead 102 includes a pane support 78' and a pane base support 100', both of which function as their counterparts on the hingedly connected glazing bead 70. The adhesive 71*b* is disposed on the glazing bead 102 between the pane base support 100' and the pane support 78'. The strip 74 of sealant can either be disposed on the frame surface 94 as shown, or can be raised thereabove so that it does not contact the surface 94.

Figure 13:
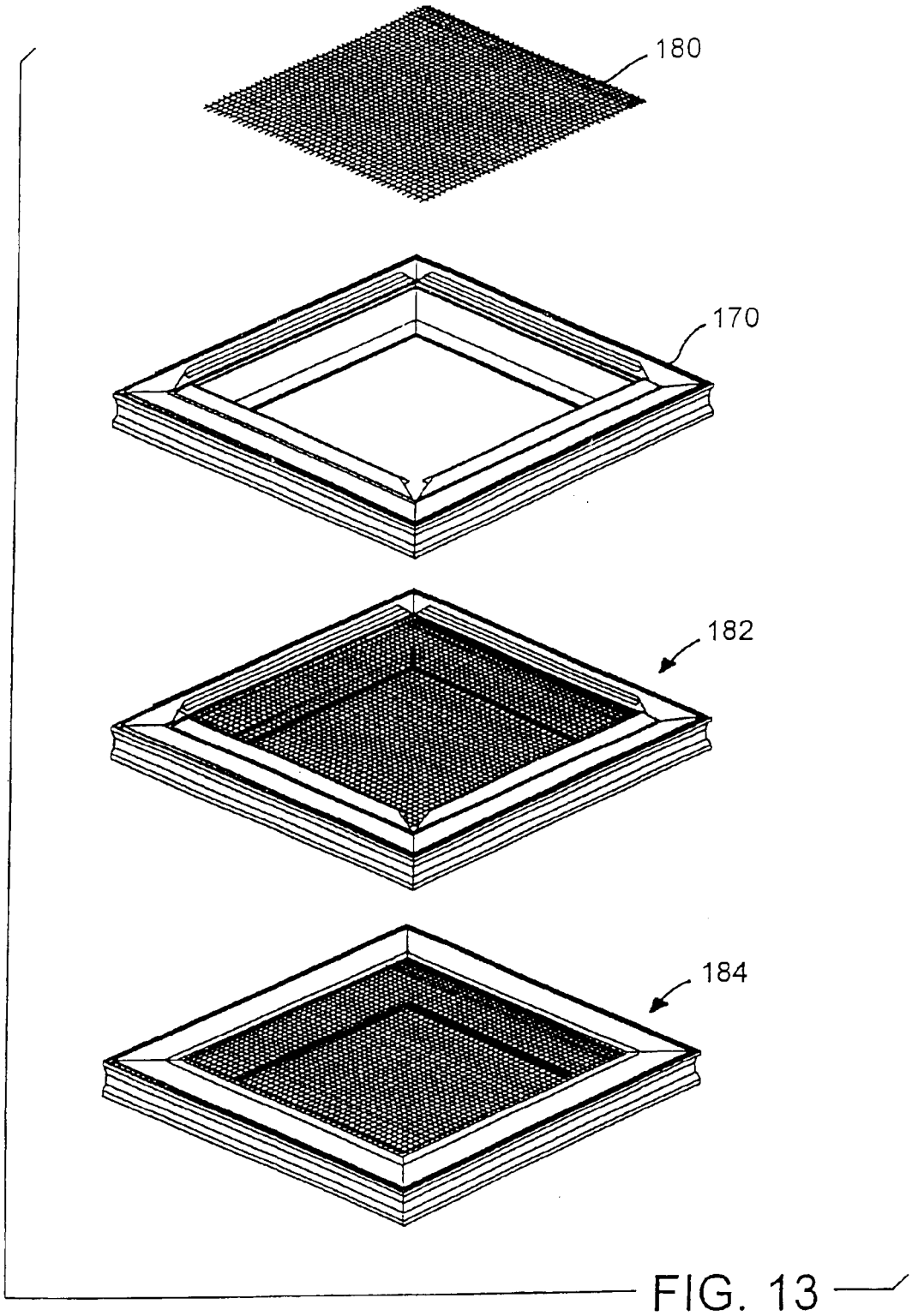
FIG. 13 is an exploded perspective view of a screen assembly using the sash frame of FIG. 12.

As an alternative to the glazing panes (e.g., pane 30*a* of FIG. 7) illustrated in the drawings, an energy panel, screen, or the like can be held in place using a hinged component such as glazing bead 70. The use of the inventive structure to hold an energy panel is particularly advantageous for single glazed units, where the energy panel provides for better insulative and sound deadening qualities in the absence of true insulating glass. A screen held in place by a hinged component in accordance with the invention can be a self supporting screen unit that includes a frame, or a simple screen mesh fabric that is stretched across the frame and held in place when the hinged component is snapped (or otherwise mounted) to the sash frame. FIG. 13, described hereinafter, illustrates a window screen assembly in accordance with an embodiment of the invention. An arrangement similar to hinged component 70 can also be used to hold a conventional double pane insulating glass unit in place, thereby providing a triple glazed unit.

In order to assemble a sash, an assembler (e.g., a person, a robot, an automated assembly machine, or a combination thereof) can begin by placing one bead of adhesive 71*b* into the fixed glazing bead 102. Then, the pane 30*b* is placed on the base support 100' against the sealant strip 71*b*. Continuing, the adhesive sealing strip 74 is placed on the frame surface 94 and/or the pane 30*b*. Finally, the adhesive 71*a* is applied to the glazing bead 70 and the glazing bead 70 is folded into position as shown by the arrow in FIG. 7. Just before the bead 70 is locked into place, the pane 30*a* is inserted between the adhesive 74 and the adhesive 71*a*, where it rests on the base support 100 which serves as a glazing block.

Figure 8:
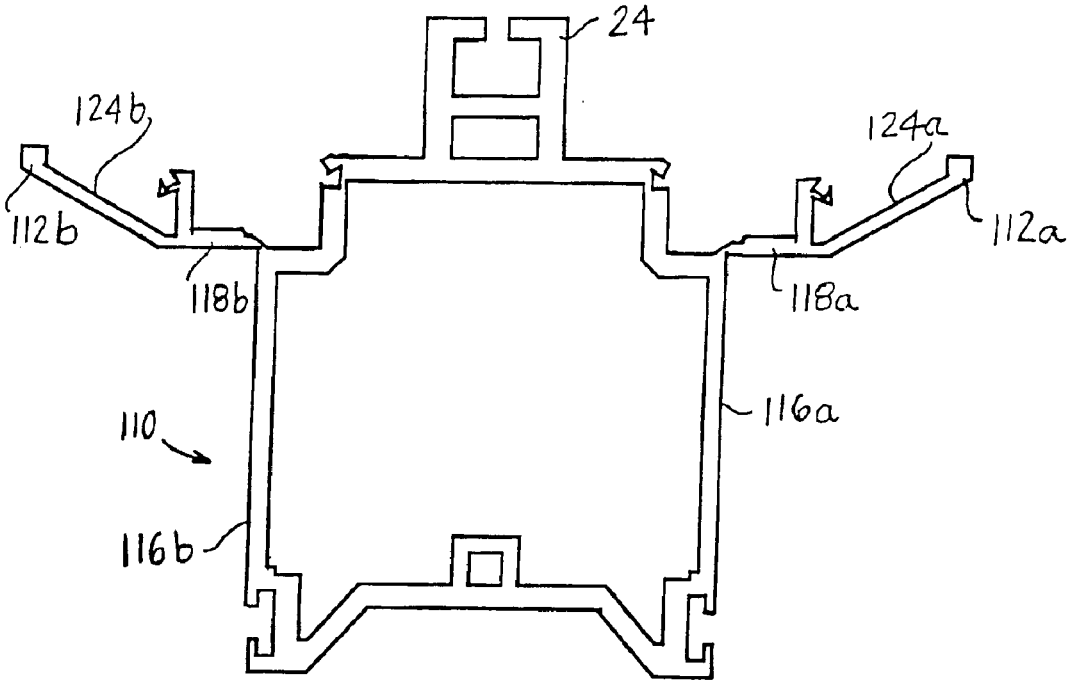
FIG. 8 is a cross-sectional view of another embodiment similar to that shown in FIG. 4, but wherein the window sash profile portion has a beveled folding glazing bead/stop in accordance with the invention.

Referring to FIG. 8, there is illustrated an alternative embodiment of a window sash profile 110 which is similar to sash profile 20 of the embodiment of FIGS. 3–6, except for the construction of the glazing beads. As in the earlier embodiments, the glazing beads 112*a*, 112*b*, as shown in FIG. 8, are adapted for securing respective glazing panes (not shown) to the integral spacing structure 24 of the sash frame 110. The glazing beads 112*a*, 112*b* extend the length of the sash frame 110 and are separate from each other.

Figure 9:
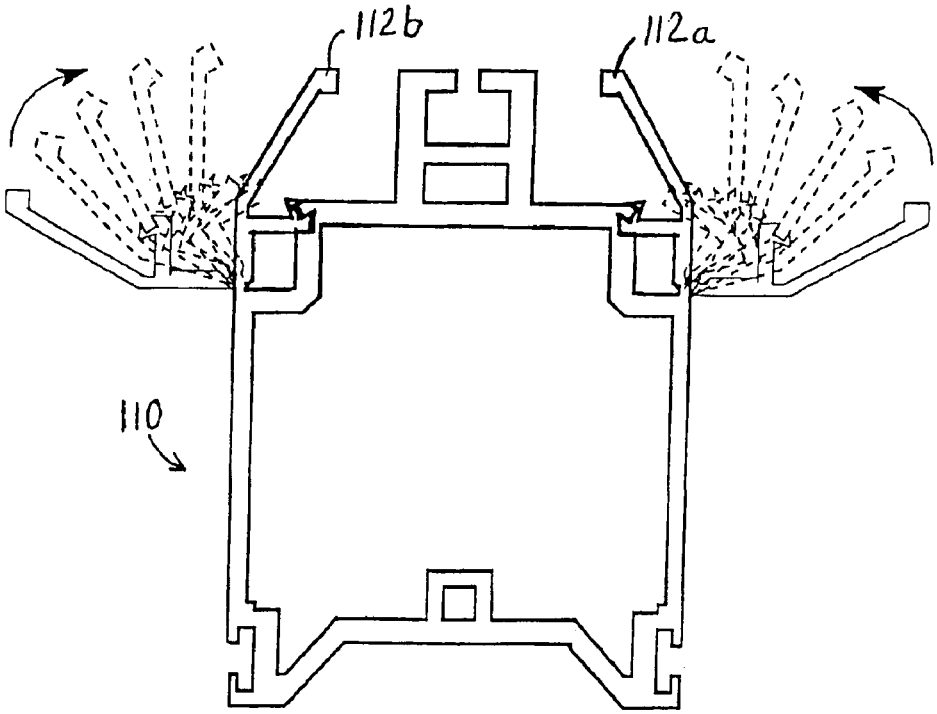
FIG. 9 is a cross-sectional view of the embodiment of FIG. 8, but wherein the glazing bead/stops are folded into a locking position, in accordance with the invention.

Each of the glazing beads 112*a*, 112*b* has a side leg 118*a*, 118*b*, respectively, which forms an extension of the side walls of the sash frame 110 when the glazing beads are locked into place as shown in FIG. 9. One end of each of the side legs 118*a*, 118*b* is hingedly and integrally connected to the sash frame 110 at the intersection of the respective sash frame side wall 116*a*, 116*b*. The opposite end of each side leg 118*a*, 118*b* is integrally connected to a first end of a respective glazing pane periphery cover 124*a*, 124*b*. The cover portions 124*a*, 124*b* extend at an angle as illustrated, to provide a beveled glazing bead structure. Additional features of the glazing beads described in connection with FIGS. 3–8, such as locking members, can also be provided with the glazing beads of FIGS. 8 and 9.

Figure 10:
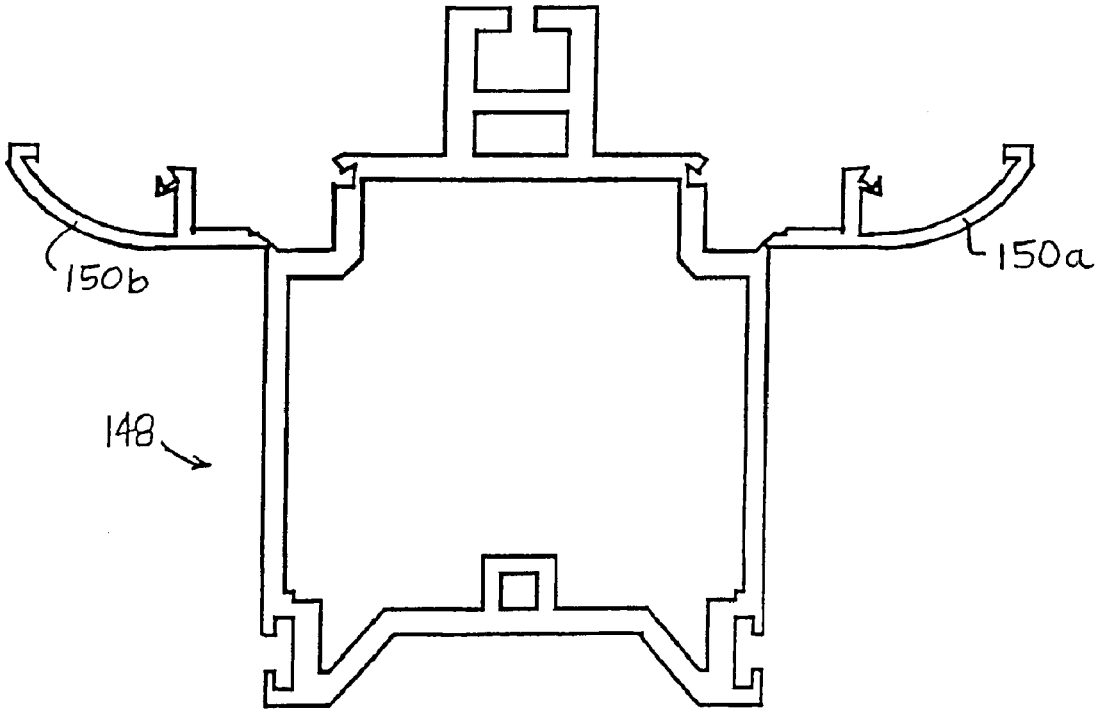
FIG. 10 is a cross-sectional view of another embodiment similar to that shown in FIG. 8, but wherein the window sash profile portion has a radius folding glazing bead/stop in accordance with the invention.

Referring to FIG. 10, there is illustrated an alternative embodiment of a window sash profile 148 which is similar to sash profile 110 of the embodiment of FIGS. 8 and 9 except for the shape of the glazing pane periphery cover portions 124*a*, 124*b*. That is, the cover portions 150*a*, 150*b* of the glazing beads in FIG. 10 are curved at an aesthetically and functionally desired radius. The remainder of the window sash construction is essentially identical to the window sash construction of FIGS. 8 and 9.

Figure 11:
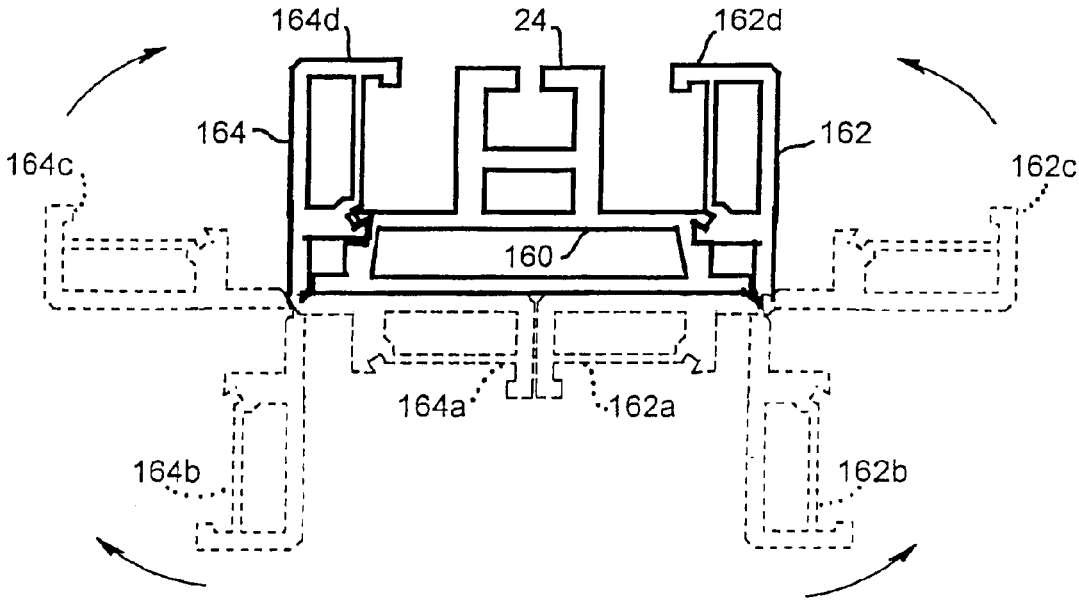
FIG. 11 is a cross-sectional view of an embodiment wherein hinged components are foldable from a starting position under a bottom section of a sash profile about 270° to a final position, where they can be snapped or otherwise fixed into place.

FIG. 11 is an embodiment wherein the hinged components 162, 164 (which can comprise, for example, glazing beads, insulating glass (IG) unit mounts, screen mounts, energy panel mounts, or the like) are rotatable from a starting position underneath the sash profile as illustrated, to a final functional position. As shown, the hinged components are rotatable from starting positions 162*a*, 164*a*, respectively (shown in phantom) through successive positions 162*b*, 164*b*, then 162*c*, 164*c*, then into the final positions 162*d*, 164*d*. In the final position, each hinged component can serve, e.g., as a glazing bead or other functional component as described in connection with previous figures.

Figure 12:
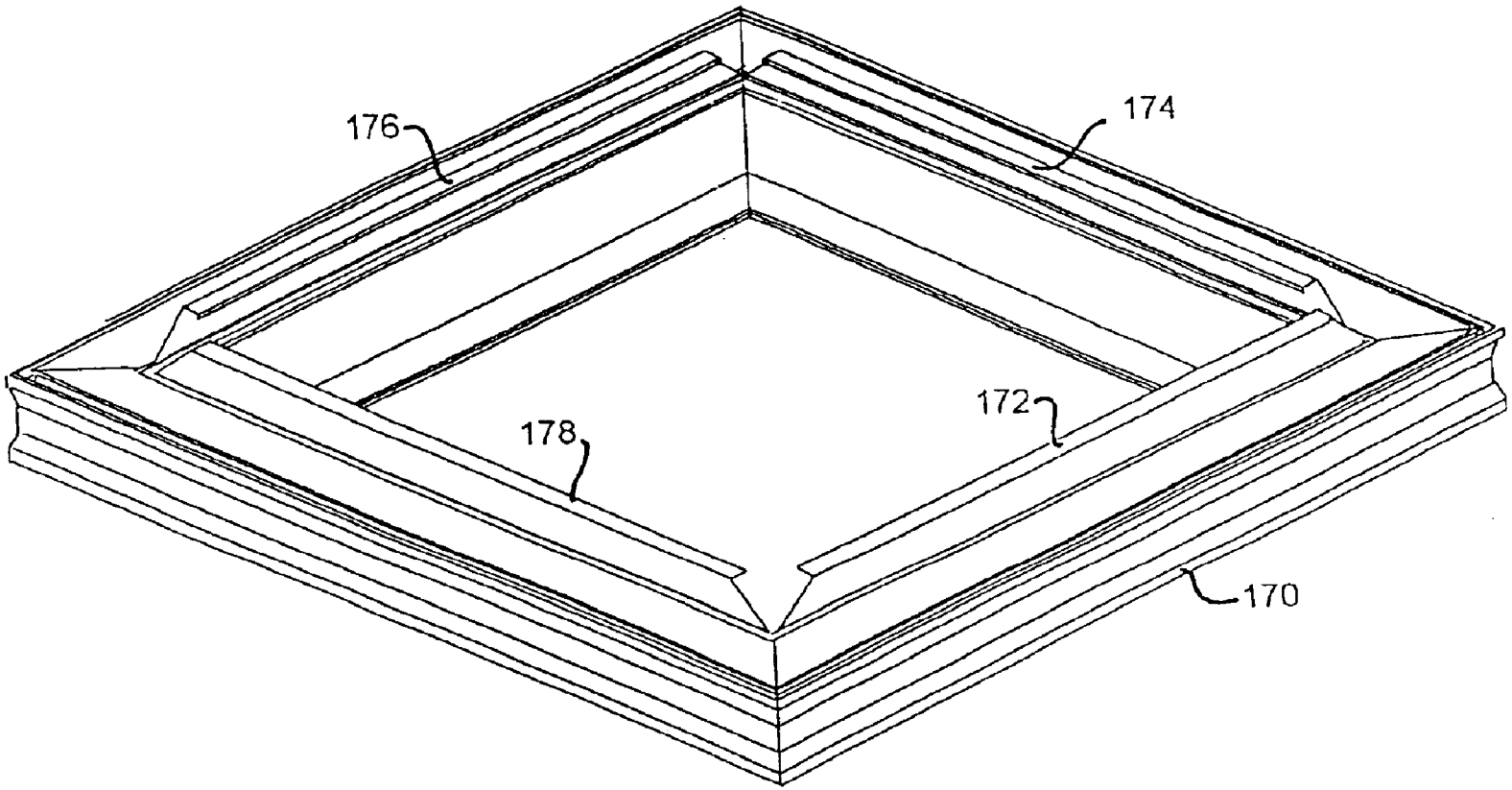
FIG. 12 is a perspective view of a completed sash frame having mitered corners with corresponding mitered hinged components.

FIG. 12 illustrates an example embodiment of a completed sash frame 170, prior to final placement of the hinged components 172, 174, 176, 178. In the illustrated example, the sash frame 170 has mitered corners, which are welded in a conventional manner. However, the welding heating plate may require special fabrication so as to allow for any excess portions of the hinged components (e.g., glazing beads) to be eliminated from the welding process.

One process for fabricating the corners is to cut the sash profile extrusion to length with miter cuts on ends thereof. For a mitered finished glazing bead (or other hinged component), the bead may require further fabrication. In particular, a small cut back can be processed in a punch press, chop saw or multi-processing machine to prevent adjacent edges of the hinged components from interfering with one another. The bead may also be cut back using a mechanism provided in a corner cleaning machine. The extruded profile pieces are then welded with a vinyl welder as well known in the window and door industry, for example, with a single, two-point or four-point welder. Other types of welds are also possible, including glued and chemically bonded joints.

It should also be appreciated that joints other than mitered joints are possible, particularly for the hinged components. For example, adjacent ends of the hinged components may meet with butt joints, may be overlaid one on top of another in an overlapping manner, or may be finished using other arrangements (e.g., an interlocking s-shape or staircase arrangement, or a feathered arrangement).

FIG. 13 illustrates the installation of a screen material 180 such as screen mesh (hereinafter "screen") into a frame, such as frame 170 of FIG. 12. When the screen 180 is to be installed into a window sash, the glazing panes will be omitted, thereby allowing the passage of air across the screen from the outside. It should be appreciated that a different, (e.g., narrower) profile can be used for the screen frame, to provide a self supporting screen unit for installation on a window, door, skylight or the like.

During assembly of the screen unit, the screen 180 is placed into the frame 170 as shown at 182. The hinged components are then folded over the edges of the screen, and snapped into place to hold the screen in the frame, as shown at 184.

Figure 14:
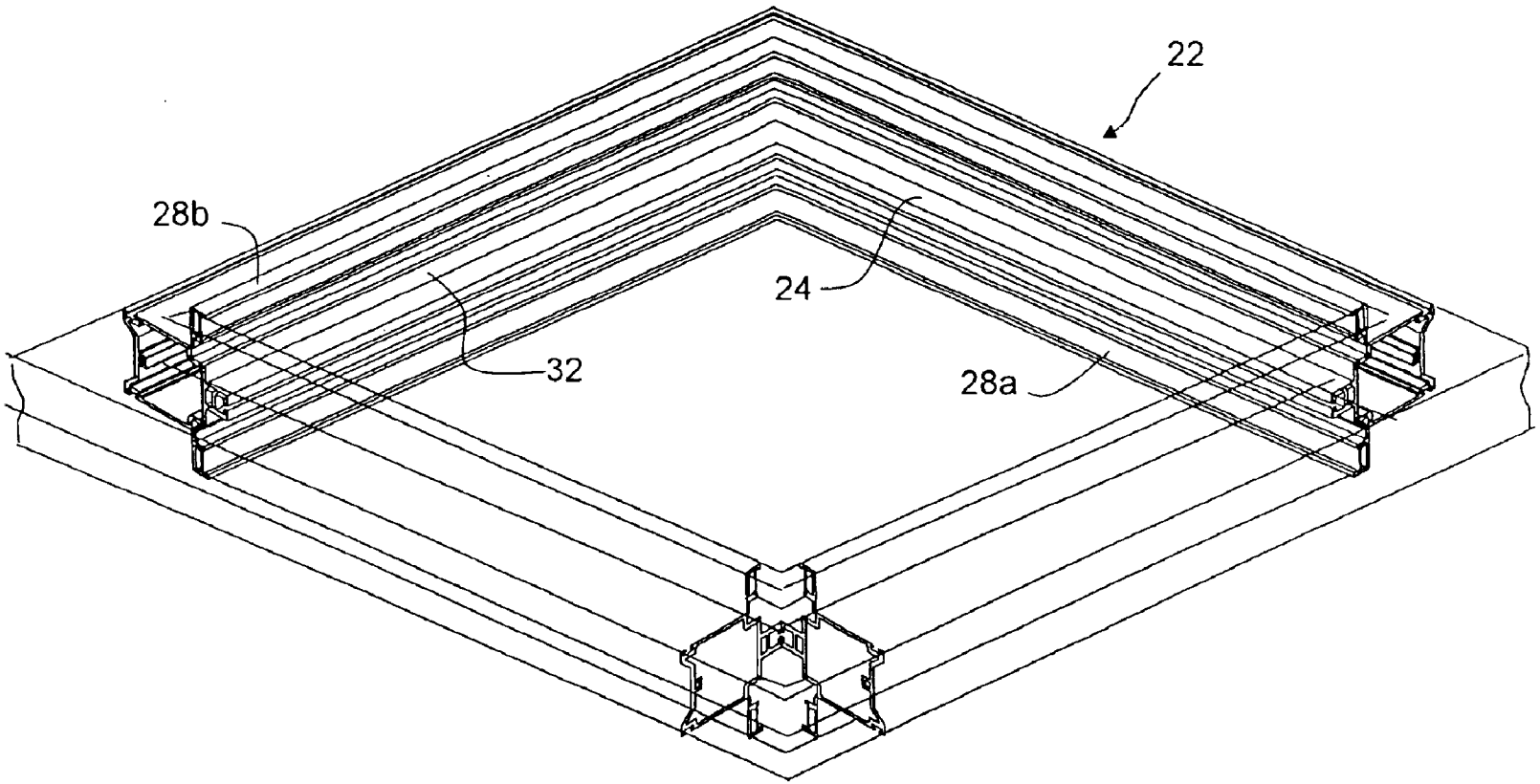
FIG. 14 is a perspective view of a sash frame in accordance with the invention showing hinged portions on both sides of the frame and glazing pane mounting surfaces extending from the inner frame surface.

FIG. 14 illustrates, in a perspective view, a sash frame 22 with mitered corners constructed from the sash profile of FIG. 4. The sash frame includes an integral spacing structure 24 extending from the inner sash frame surface (inner facing frame surface) 32 as described above. Glazing beads or clips 28*a*, 28*b*, in the form of first and second hinged components, are provided on opposite sides of the sash profile.

Various alternative structures are possible in accordance with the inventive concept. For example, it is conceivable for both a glazing leg (to which the glazing pane is mounted) and a glazing bead (which is folded against the glazing pane after the pane is mounted to the glazing leg) to be formed in a unitary hinged structure (or as separate hinged components). In such a structure, the glazing leg would first be folded into place along a corresponding hinge line. The glazing pane would be mounted to the glazing leg. Then, the bead would be folded along its hinge line against the outer surface of the glazing pane.

Moreover, multiple hinged components can be provided in the sash profile to build up legs for supporting glazing pane(s) or the like, and to provide external glazing beads.

Still further, components such as thermometers, outside and/or inside temperature indicating strips, gas, particle or bio-agent monitoring sensors, and security alarm components can be incorporated into the hinged glazing bead or other components of the window sash.

Although the invention has been described in connection with several particular embodiments, it will be appreciated that various adaptations and modifications may be made thereto without departing from the scope of the invention, as set forth in the claims.

What is claimed is:

1. A window sash frame comprising:

an inner facing frame surface extending substantially around the sash frame;

first and second glazing pane mounting surfaces extending from said inner facing frame surface;

a first hinged component extending substantially over the length of at least one portion the sash frame and being hingedly attached to at least one of:

(i) the first glazing pane mounting surface, (ii) said inner facing frame surface;

a second hinged component extending substantially over the length of said at least one portion and being hingedly attached to at least one of:

(i) the second glazing pane mounting surface, (ii) said inner facing frame surface;

wherein said first and second hinged components are adapted to be pivoted towards the first and second glazing pane mounting surfaces, respectively.

2. The window sash of claim 1 wherein:

said first hinged component functions as a glazing bead for a first glazing pane mounted to the first glazing pane mounting surface, and said second hinged component functions as a glazing bead for a second glazing pane mounted to the second glazing pane mounting surface.

3. The window sash frame of claim 2 wherein:

said first and second hinged components are affixed to the first and second glazing panes, respectively, using an adhesive sealant.

4. The window sash frame of claim 1 further including:

a first locking member for locking the first hinged component in position adjacent the first glazing pane mounting surface; and a second locking member for locking the second hinged component in position adjacent the second glazing pane mounting surface.

5. The window sash frame of claim 2, further comprising:

a first strip of adhesive between an end of said first glazing bead and said first glazing pane; and a second strip of adhesive between an end of said second glazing bead and said second glazing pane.

6. The window sash frame of claim 5 further comprising:

a third strip of adhesive located adjacent the inner facing frame surface and adapted to extend between the first and second glazing panes.

7. The window sash frame of claim 1 wherein said first and second hinged components extend around substantially the entire perimeter of said sash frame, adjacent opposite sides of the inner facing frame surface.

8. The window sash frame of claim 1, wherein the first and second hinged components are adapted to hold at least one of:

(i) a glazing pane, (ii) an insulating glass unit, (iii) a window screen, (iv) an energy panel to the window sash.

9. The window sash frame of claim 1, wherein said first and second hinged components are adapted to be folded from an initial position on the sash frame through an arc of about 270° to a final functional position.

* * * * *